US008044600B2

(12) United States Patent
Yan et al.

(10) Patent No.: US 8,044,600 B2
(45) Date of Patent: Oct. 25, 2011

(54) BRIGHTNESS-ADJUSTABLE LED DRIVING CIRCUIT

(75) Inventors: Shang-Jin Yan, Taoyuan Hsien (TW); Chung-Tsai Huang, Taoyuan Hsien (TW); Po-Yi Lee, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 468 days.

(21) Appl. No.: 12/236,237

(22) Filed: Sep. 23, 2008

(65) Prior Publication Data

US 2009/0315480 A1 Dec. 24, 2009

(30) Foreign Application Priority Data

Jun. 18, 2008 (TW) ..... 97122710 A

(51) Int. Cl.
*H05B 37/02* (2006.01)

(52) U.S. Cl. ..... 315/219; 315/247; 315/308

(58) Field of Classification Search ..... 315/209 R, 315/219, 247, 254, 291, 307, 308
See application file for complete search history.

(56) References Cited

U.S. PATENT DOCUMENTS 6,172,466 B1 * 1/2001 Ki et al. ..... 315/224
6,940,733 B2 * 9/2005 Schie et al. ..... 363/21.12
6,944,034 B1 * 9/2005 Shteynberg et al. ..... 363/21.13
7,852,017 B1 * 12/2010 Melanson ..... 315/291
2008/0030148 A1 * 2/2008 Tang et al. ..... 315/291

* cited by examiner

*Primary Examiner* — Thuy Vinh Tran
(74) *Attorney, Agent, or Firm* — Kirton & McConkie; Evan R. Witt

(57) ABSTRACT

A brightness-adjustable LED driving circuit includes a rectifying and filtering circuit, a power factor correction power conversion circuit, and a detecting and controlling circuit. The rectifying and filtering circuit is used for filtering and rectifying a brightness adjusting voltage into a first DC voltage. The power factor correction power conversion circuit is electrically connected to the rectifying and filtering circuit and at least one LED string for generating an output current required for powering the at least one LED string. The detecting and controlling circuit detects phase data of the brightness adjusting voltage and the output current generated by the power factor correction power conversion circuit. The detecting and controlling circuit generates a control signal to the power factor correction controller according to the phase data of the brightness adjusting voltage, so that the magnitude of the output current is changed according to the phase data of the brightness adjusting voltage.

19 Claims, 7 Drawing Sheets

BRIGHTNESS-ADJUSTABLE LED DRIVING CIRCUIT

FIELD OF THE INVENTION

The present invention relates to a LED driving circuit, and more particularly to a brightness-adjustable LED driving circuit.

BACKGROUND OF THE INVENTION

Incandescent lamps such as tungsten filament lamps or halogen lamps are widely used as sources of artificial light. In the early stage, incandescent lamps are used for simply providing a bright place. With diversified living attitudes, incandescent lamps having difference brightness are developed. For adjusting brightness of respective incandescent lamp, a brightness-adjustable circuit is used to drive the incandescent lamp and control the brightness of the incandescent lamp.

FIG. 1 is a schematic circuit diagram illustrating a brightness-adjustable circuit for a conventional incandescent lamp. As shown in FIG. 1, the brightness-adjustable circuit 1 includes a switch element 11 and a triggering circuit 12. The switch element 11 is for example a solid semiconductor component such as a silicon-controlled rectifier (SCR) or a TRIode for Alternating Current (TRAIC) component. Take a TRAIC component as the switch element 11 for example. The control terminal G is the gate of the switch element 11. The first terminal $T_1$ and the control terminal G of the switch element 11 are coupled to the incandescent lamp 13 and the triggering circuit 12, respectively. The second terminal $T_2$ of the switch element 11 can receive the electric energy from the input voltage $V_{in}$. The triggering circuit 12 can control the on phase or on duration of the switch element 11, thereby controlling the electricity to be transmitted to the incandescent lamp 13.

Please refer to FIG. 1 again. The triggering circuit 12 includes a resistor R, a variable resistor $R_{var}$, a capacitor C and a bidirectional diode thyristor D. The resistor R, the variable resistor $R_{var}$ and the capacitor C are connected in serried with each other to form a charging loop. Both ends of these serially-connected components are coupled to the second terminal $T_2$ of the switch element 11 and the incandescent lamp 13, respectively. An end of the bidirectional diode thyristor D is coupled to the control terminal G of the switch element 11. The other end of the bidirectional diode thyristor D is coupled to the capacitor C. Through the charging loop which is defined by the resistor R, the variable resistor $R_{var}$ and the capacitor C, the input voltage $V_{in}$, can charge the capacitor C. Until the capacitor C is charged to the turn-on voltage of the bidirectional diode thyristor D, the bidirectional diode thyristor D is conducted and thus a triggering signal is transmitted to the control terminal G of the switch element 11. In response to the triggering signal, the switch element 11 is conducted. That is, the on phase or on duration of the switch element 11 can be controlled by adjusting the resistance of the resistor R, thereby controlling the electricity to be transmitted to the incandescent lamp 13 and adjusting the brightness of the incandescent lamp 13.

In recent years, light emitting diodes (LEDs) capable of emitting light with high brightness and high illuminating efficiency have been developed. In comparison with a common incandescent light, a LED has lower power consumption, long service life, and quick response speed. With the maturity of the LED technology, LEDs will replace all conventional lighting devices. Until now, LEDs are widely used in many aspects of daily lives, such as automobile lighting devices, handheld lighting devices, backlight sources for LCD panels, traffic lights, indicator board displays, and the like.

The brightness-adjustable circuit is only applicable to the incandescent lamp with the pure resistive property. On the other hand, the conventional LED driving circuit is operated according to the non-pure resistive property of the LED. Generally, there is often a phase difference between the input current and the input voltage at the input side of the conventional LED driving circuit and the waveforms of the input current and the input voltage are very distinguished. If the LED driving circuit and the brightness-adjustable circuit are simultaneously used, the LED possibly flashes or the LED driving circuit or the brightness-adjustable circuit is readily burnt out because the LED driving circuit can only receive power signals with constant on phase or on duration. Moreover, the conventional LED driving circuit fails to receive the power signals which are subject to brightness regulation and have varied on phase or on duration. In other words, the conventional LED driving circuit fails to cooperate with the brightness-adjustable circuit.

There is a need of providing a brightness-adjustable LED driving circuit to obviate the drawbacks encountered from the prior art.

SUMMARY OF THE INVENTION

It is an object of the present invention to provide a brightness-adjustable LED driving circuit cooperating with a brightness-adjustable circuit to adjust brightness of one or more LED strings while avoiding the problem of burning out the LED driving circuit or the brightness-adjustable circuit.

Another object of the present invention provides a brightness-adjustable LED driving circuit having enhanced power factor and reduced electromagnetic interference (EMI).

Another object of the present invention provides a brightness-adjustable LED driving circuit, in which the input current and the input voltage have identical waveforms and the brightness-adjustable LED driving circuit is nearly operated according to the pure resistive property of the incandescent lamp.

In accordance with an aspect of the present invention, there is provided a brightness-adjustable LED driving circuit for driving at least one LED string and adjusting brightness of the at least one LED string. The brightness-adjustable LED driving circuit includes a brightness-adjustable circuit, a rectifying and filtering circuit, a power factor correction power conversion circuit, and a detecting and controlling circuit. The brightness-adjustable circuit receives an input AC voltage and adjusts the phase of the input AC voltage, thereby generating a brightness adjusting voltage. The rectifying and filtering circuit is electrically connected to an output terminal of the brightness-adjustable circuit for filtering and rectifying the brightness adjusting voltage into a first DC voltage. The power factor correction power conversion circuit is electrically connected to the rectifying and filtering circuit and the at least one LED string for generating an output current required for powering the at least one LED string. The power factor correction power conversion circuit includes a power factor correction controller. The detecting and controlling circuit is connected to the rectifying and filtering circuit and the power factor correction controller of the power factor correction power conversion circuit for detecting phase data of the brightness adjusting voltage and the output current generated by the power factor correction power conversion circuit. The detecting and controlling circuit generates a control signal to the power factor correction controller according to the phase data of the brightness adjusting voltage, so that the magnitude of the output current is changed according to the phase data of the brightness adjusting voltage.

In accordance with another aspect of the present invention, there is provided a brightness-adjustable LED driving circuit for driving at least one LED string and adjusting brightness of the at least one LED string. The brightness-adjustable LED driving circuit includes a rectifying and filtering circuit, a power factor correction power conversion circuit, and a detecting and controlling circuit. The rectifying and filtering circuit is used for filtering and rectifying a brightness adjusting voltage into a first DC voltage. The power factor correction power conversion circuit is electrically connected to the rectifying and filtering circuit and the at least one LED string for generating an output current required for powering the at least one LED string. The power factor correction power conversion circuit includes a power factor correction controller. The detecting and controlling circuit is connected to the rectifying and filtering circuit and the power factor correction controller of the power factor correction power conversion circuit for detecting phase data of the brightness adjusting voltage and the output current generated by the power factor correction power conversion circuit. The detecting and controlling circuit generates a control signal to the power factor correction controller according to the phase data of the brightness adjusting voltage, so that the magnitude of the output current is changed according to the phase data of the brightness adjusting voltage.

The above contents of the present invention will become more readily apparent to those ordinarily skilled in the art after reviewing the following detailed description and accompanying drawings, in which:

DETAILED DESCRIPTION OF THE PREFERRED EMBODIMENT

Figure 1:
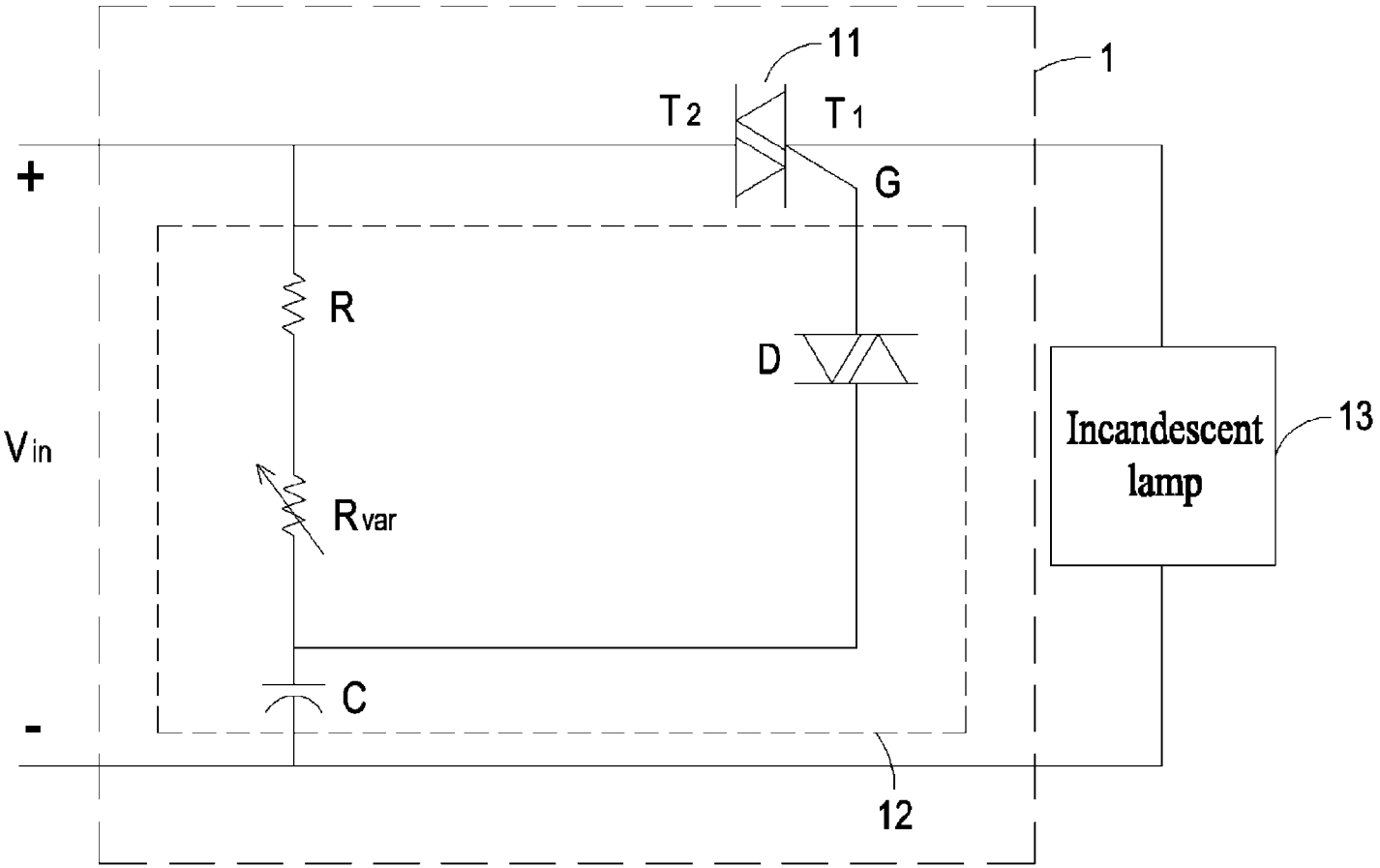
FIG. 1 PRIOR ART
FIG. 1 is a schematic circuit diagram illustrating a brightness-adjustable circuit for a conventional incandescent lamp.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The brightness-adjustable LED driving circuit of the present invention can be used for driving one or more LED strings. Each LED string includes one or more LEDs. For clarification, two LED strings of each having two LEDs are shown in the drawings.

Figure 2:
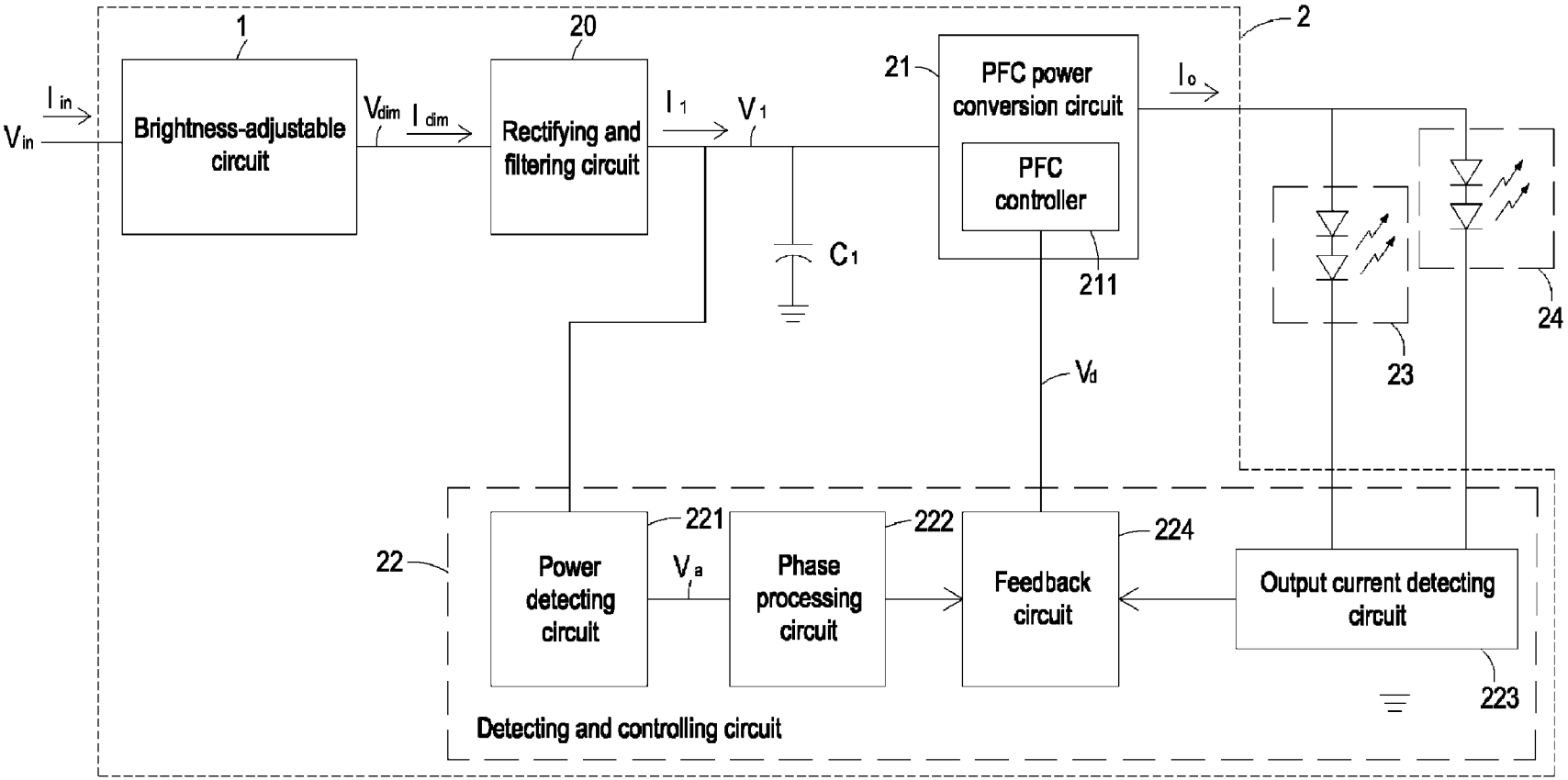
FIG. 2 is a schematic circuit block diagram illustrating a brightness-adjustable LED driving circuit according to a preferred embodiment of the present invention.

FIG. 2 is a schematic circuit block diagram illustrating a brightness-adjustable LED driving circuit according to a preferred embodiment of the present invention. As shown in FIG. 2, the brightness-adjustable LED driving circuit 2 of the present invention principally comprises a brightness-adjustable circuit 1, a rectifying and filtering circuit 20, a power factor correction (PFC) power conversion circuit 21 and a detecting and controlling circuit 22.

The brightness-adjustable circuit 1 is electrically connected to the rectifying and filtering circuit 20. By the brightness-adjustable circuit 1, an input AC voltage $V_{in}$, is received and converted into a brightness adjusting voltage $V_{dim}$. The rectifying and filtering circuit 20 is electrically connected to the brightness-adjustable circuit 1, the PFC power conversion circuit 21 and the detecting and controlling circuit 22. By the rectifying and filtering circuit 20, the brightness adjusting voltage $V_{dim}$ is received, filtered and rectified into a first DC voltage $V_1$. The PFC power conversion circuit 21 is electrically connected to the rectifying and filtering circuit 20 and the detecting and controlling circuit 22. By the PFC power conversion circuit 21, the first DC voltage $V_1$ is converted into a regulated voltage required to power one or more LED strings such as a first LED string 23 and a second LED string 24. The detecting and controlling circuit 22 is electrically connected to the rectifying and filtering circuit 20, the PFC controller 211 of the PFC power conversion circuit 21 and the output loop of the PFC power conversion circuit 21 for detecting the on phase or on duration of the brightness adjusting voltage $V_{dim}$, and the output current $I_o$ of the PFC power conversion circuit 21. According to the on phase or on duration of the brightness adjusting voltage $V_{dim}$, and the output current $I_o$ of the PFC power conversion circuit 21, a control signal $V_d$ is transmitted to the PFC controller 211 of the PFC power conversion circuit 21. As a consequence, the output current $I_o$ of the PFC power conversion circuit 21 is changed according to the phase data (e.g. the on phase or on duration) of the brightness adjusting voltage $V_{dim}$. Please refer to FIG. 2 again. The detecting and controlling circuit 22 comprises a power detecting circuit 221, a phase processing circuit 222, an output current detecting circuit 223 and a feedback circuit 224. The power detecting circuit 221 is electrically connected to the rectifying and filtering circuit 20 and the phase processing circuit 222 for detecting the brightness adjusting voltage $V_{dim}$ and generating a power detecting signal $V_a$ to be received by the phase processing circuit 222. The phase of the power detecting signal $V_a$ is identical to that of the brightness adjusting voltage $V_{dim}$. The phase processing circuit 222 is electrically connected to the power detecting circuit 221 and the feedback circuit 224 for processing the power detecting signal $V_a$, thereby acquiring the phase data associated with the brightness adjusting voltage $V_{dim}$. According to the phase data of the brightness adjusting voltage $V_{dim}$, a phase signal is transmitted to the feedback circuit 224. The output current detecting circuit 223 is electrically connected to the feedback circuit 224 and the output loop of the PFC power conversion circuit 21 for detecting the magnitude of the output current $I_o$ of the PFC power conversion circuit 21. According to the magnitude of the output current $I_o$, the output current detecting circuit 223 issues an output current detecting signal to the feedback circuit 224. In this embodiment, the output current detecting circuit 223 is electrically connected to the first LED string 23 and a second LED string 24 for detecting the magnitude of the output current $I_o$ of the PFC power conversion circuit 21. The feedback circuit 224 is electrically connected to the PFC controller 211, the phase processing circuit 222 and the output current detecting circuit 223. According to the phase signal issued by the phase processing circuit 222 and the output current detecting signal issued by the output current detecting circuit 223, the feedback circuit 224 issues a corresponding control signal $V_d$ to the PFC controller 211 of the PFC power conversion circuit 21. As a consequence, the output current $I_o$ of the PFC power conversion circuit 21 is changed according to the phase data of the brightness adjusting voltage $V_{dim}$. In particular, the control signal $V_d$ generated by the feedback circuit 224 is adjusted according to the phase data of the brightness adjusting voltage $V_{dim}$ and the output current $I_o$ of the PFC power conversion circuit 21. In other words, according to the control signal $V_d$, the detecting and controlling circuit 22 will control the output current $I_o$ of the PFC power conversion circuit 21 to be changed according to the phase data of the brightness adjusting voltage $V_{dim}$.

In addition, the brightness-adjustable LED driving circuit 2 comprises a first capacitor $C_1$, which is connected to the output terminal of the rectifying and filtering circuit 20, for filtering off the high frequency voltage component included in the first DC voltage $V_1$.

Figure 3:
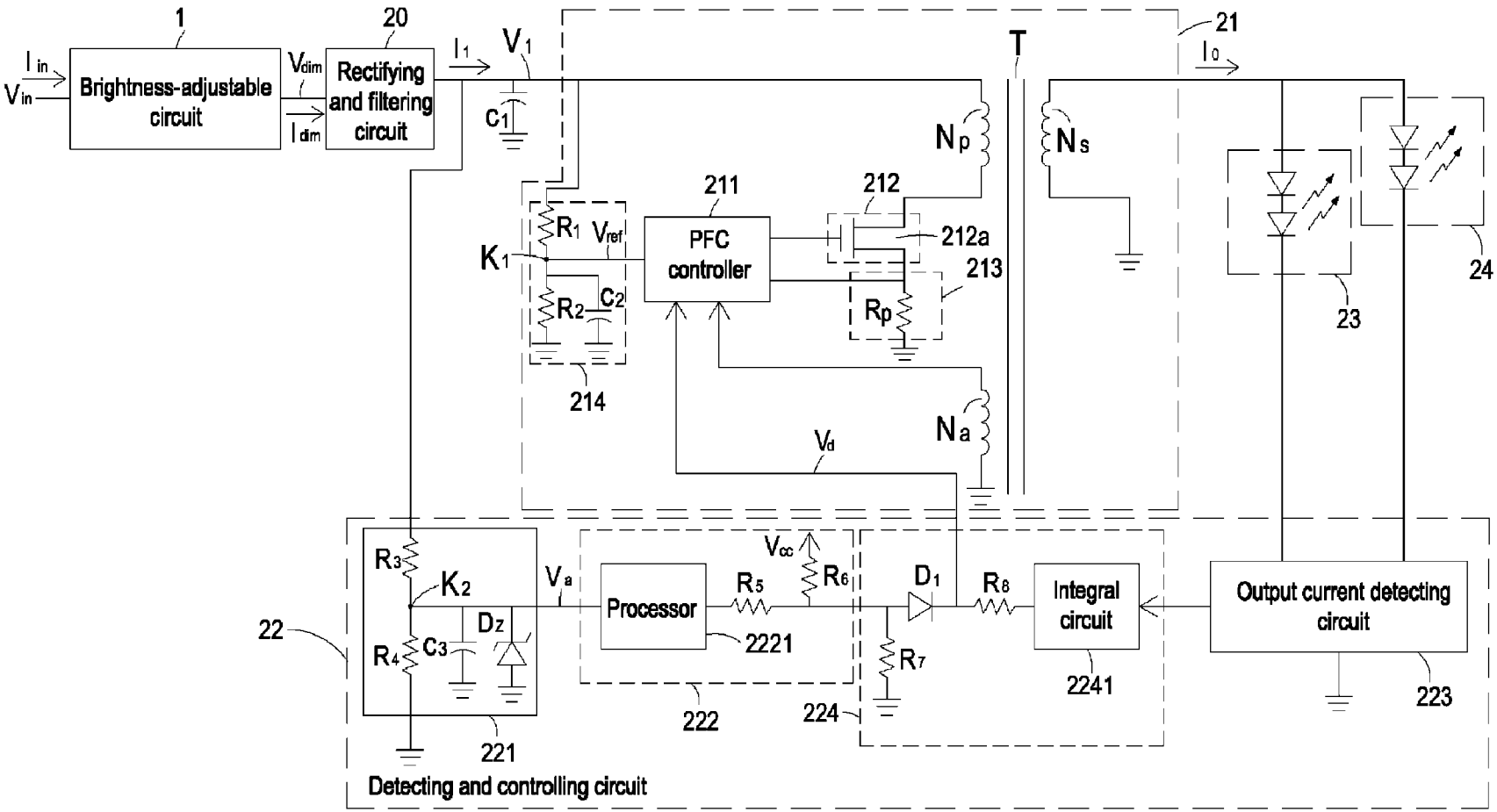
FIG. 3 is a schematic detailed circuit diagram of the brightness-adjustable LED driving circuit of FIG. 2.

FIG. 3 is a schematic detailed circuit diagram of the brightness-adjustable LED driving circuit of FIG. 2. Please refer to FIGS. 2 and 3. In this embodiment, the PFC power conversion circuit 21 is a single-stage power conversion circuit, which comprises a transformer T, a switching circuit 212, a current detecting circuit 213 and a voltage detecting current 214. The transformer T comprises a primary winding assembly $N_p$, a secondary winding assembly $N_s$ and an auxiliary winding assembly $N_a$. The primary winding assembly $N_p$ is electrically connected to the output side of the rectifying and filtering circuit 20. The electrical energy of the first DC voltage $V_1$ is received by the primary winding assembly $N_p$ and transmitted to the secondary winding assembly $N_s$. The auxiliary winding assembly $N_a$ is electrically connected to the PFC controller 211 for sensing the voltage of the primary winding assembly $N_p$ and the sensing result is transmitted to the PFC controller 211. According to the sensing result, the PFC controller 211 will discriminate whether the primary winding assembly $N_p$ is in a zero-current state. In some embodiments, the auxiliary winding assembly $N_a$ may provide power required for the operating the PFC controller 211. The switching circuit 212 is electrically connected to the primary winding assembly $N_p$ and the PFC controller 211. In some embodiments, the switching circuit 212 includes a metal oxide semiconductor field effect transistor (MOSFET) 212*a*. The current detecting circuit 213 is electrically connected to the switching circuit 212 and the PFC controller 211 for detecting the current flowing through the primary winding assembly $N_p$. According to the magnitude of the current flowing through the primary winding assembly $N_p$, a corresponding current detecting signal is issued to the PFC controller 211. In some embodiments, the current detecting circuit 213 comprises a detecting resistor $R_p$ or a current transformer (CT). The voltage detecting current 214 is electrically connected to the output terminal of the rectifying and filtering circuit 20 for detecting the magnitude of the first DC voltage $V_1$. According to the magnitude of the first DC voltage $V_1$, the voltage detecting current 214 issues a reference voltage $V_{ref}$ to the PFC controller 211.

The voltage detecting current 214 comprises a first resistor $R_1$, a second resistor $R_2$ and a second capacitor $C_2$. The first resistor $R_1$ and the second resistor $R_2$ are connected in series to a first node $K_1$. The second capacitor $C_2$ is connected to the second resistor $R_2$ in parallel. By the serially-connected components $R_1$ and $R_2$, the first DC voltage $V_1$ is subject to voltage division so as to generate the reference voltage $V_{ref}$.

The power detecting circuit 221 of the detecting and controlling circuit 22 comprises a third resistor $R_3$, a fourth resistor $R_4$, a third capacitor $C_3$ and a Zener diode $D_z$. The third resistor $R_3$ and the fourth resistor $R_4$ are connected in series to a second node $K_2$. The third capacitor $C_3$ and the Zener diode $D_z$ are connected to the fourth resistor $R_4$ in parallel. By the serially-connected components $R_3$ and $R_4$, the first DC voltage $V_1$ is subject to voltage division so as to generate the power detecting signal $V_a$, which has the same phase as the brightness adjusting voltage $V_{dim}$.

The phase processing circuit 222 of the detecting and controlling circuit 22 comprises a processor 2221, a fifth resistor $R_5$ and a sixth resistor $R_6$. An example of the processor 2221 is a digital signal processor (DSP). The processor 2221 has an end connected to the second node $K_2$ of the power detecting circuit 221 and the other end connected to an end of the fifth resistor $R_5$. The other end of the fifth resistor $R_5$ is connected to an end of the sixth resistor $R_6$. The other end of the sixth resistor $R_6$ is connected to a DC source voltage $V_{cc}$. In receipt of the power detecting signal $V_a$, the processor 2221 acquires the phase data of the brightness adjusting voltage $V_{dim}$. According to the phase data of the brightness adjusting voltage $V_{dim}$, the current is limited by the fifth resistor $R_5$ and the voltage is pulled up by the sixth resistor $R_6$, thereby issuing a corresponding phase signal to the feedback circuit 224.

The feedback circuit 224 of the detecting and controlling circuit 22 comprises a seven resistor $R_7$, an eight resistor $R_8$, a first diode $D_1$ and an integral circuit 2241. The seven resistor $R_7$ has an end connected to the output terminal of the phase processing circuit 222, an anode of the first diode $D_1$ and a common terminal. The cathode of the first diode $D_1$ is connected to the PFC controller 211 and an end of the eight resistor $R_8$. The other end of the eight resistor $R_8$ is connected to an end of the integral circuit 2241. The other end of the integral circuit 2241 is connected to the output terminal of the output current detecting circuit 223.

Figure 4:
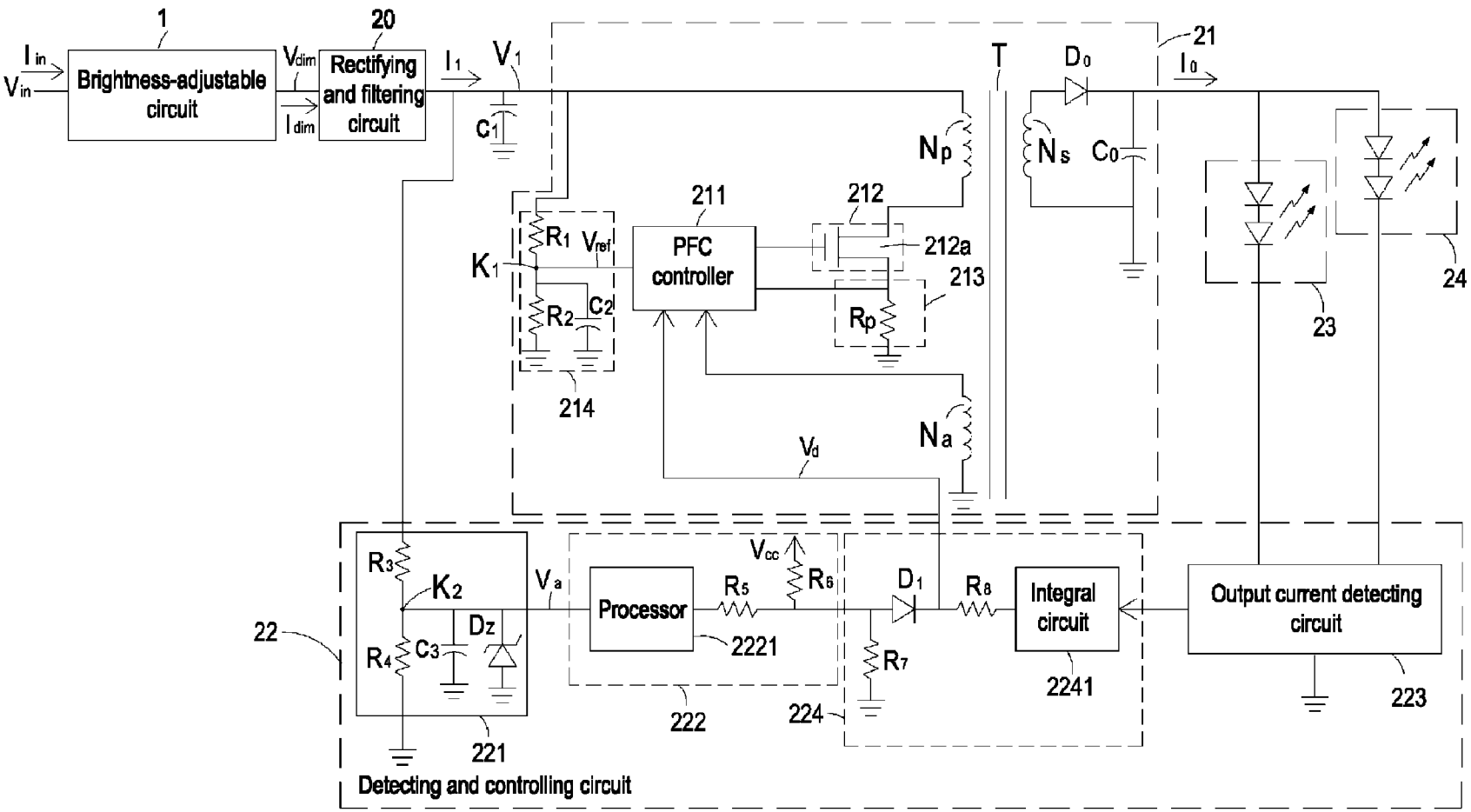
FIG. 4 is another schematic detailed circuit diagram of the brightness-adjustable LED driving circuit of FIG. 2.

Please refer to FIGS. 2, 3 and 4. FIG. 4 is another schematic detailed circuit diagram of the brightness-adjustable LED driving circuit of FIG. 2. In comparison with the brightness-adjustable LED driving circuit of FIG. 3, an output diode $D_o$ and an output capacitor $C_o$ are included in the output side of the PFC power conversion circuit 21 of the brightness-adjustable LED driving circuit shown in FIG. 4. The output diode $D_o$ is connected to the output loop of the PFC power conversion circuit 21 in series for rectification. The output capacitor $C_o$ is connected to the LED strings and the command terminal for filtering or stabilizing the output voltage of the PFC power conversion circuit 21.

Figure 5:
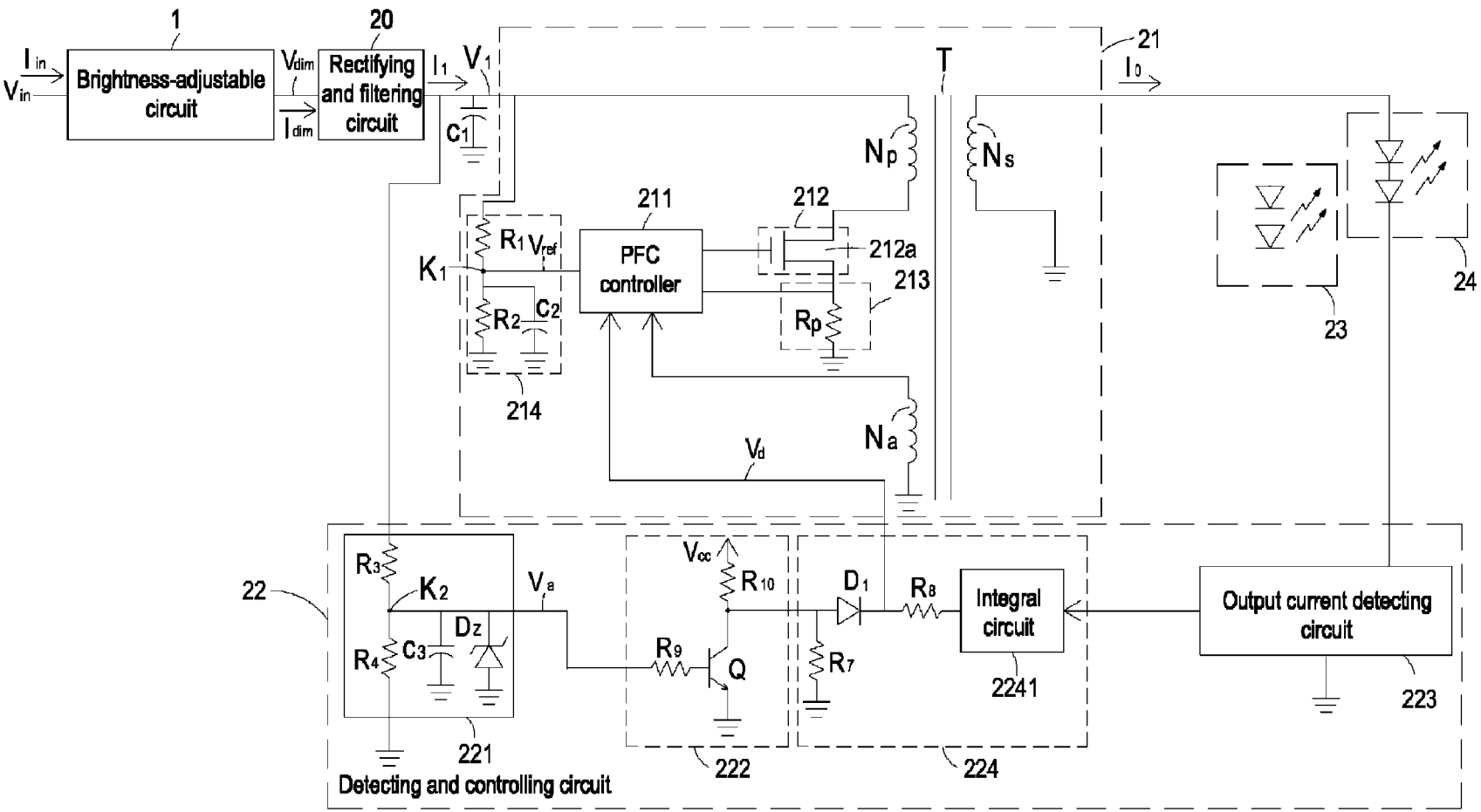
FIG. 5 is another schematic detailed circuit diagram of the brightness-adjustable LED driving circuit of FIG. 2.

Please refer to FIGS. 2, 3 and 5. FIG. 5 is another schematic detailed circuit diagram of the brightness-adjustable LED driving circuit of FIG. 2. In comparison with the brightness-adjustable LED driving circuit of FIG. 3, the phase processing circuit 222 is distinguished. In this embodiment, the phase processing circuit 222 comprises a ninth resistor $R_9$, a tenth resistor $R_{10}$ and a transistor Q. Both ends of the ninth resistor $R_9$ are connected to the output terminal of the power detecting circuit 221 and the base of the transistor Q. The tenth resistor $R_{10}$ has an end connected to the DC source voltage $V_{cc}$ and the other end connected to the collector of the transistor Q and the feedback circuit 224. By cooperation of the ninth resistor $R_9$, the tenth resistor $R_{10}$ and the transistor Q, the phase signal is transmitted to the feedback circuit 224 according to the phase data of the brightness adjusting voltage $V_{dim}$.

Figure 6:
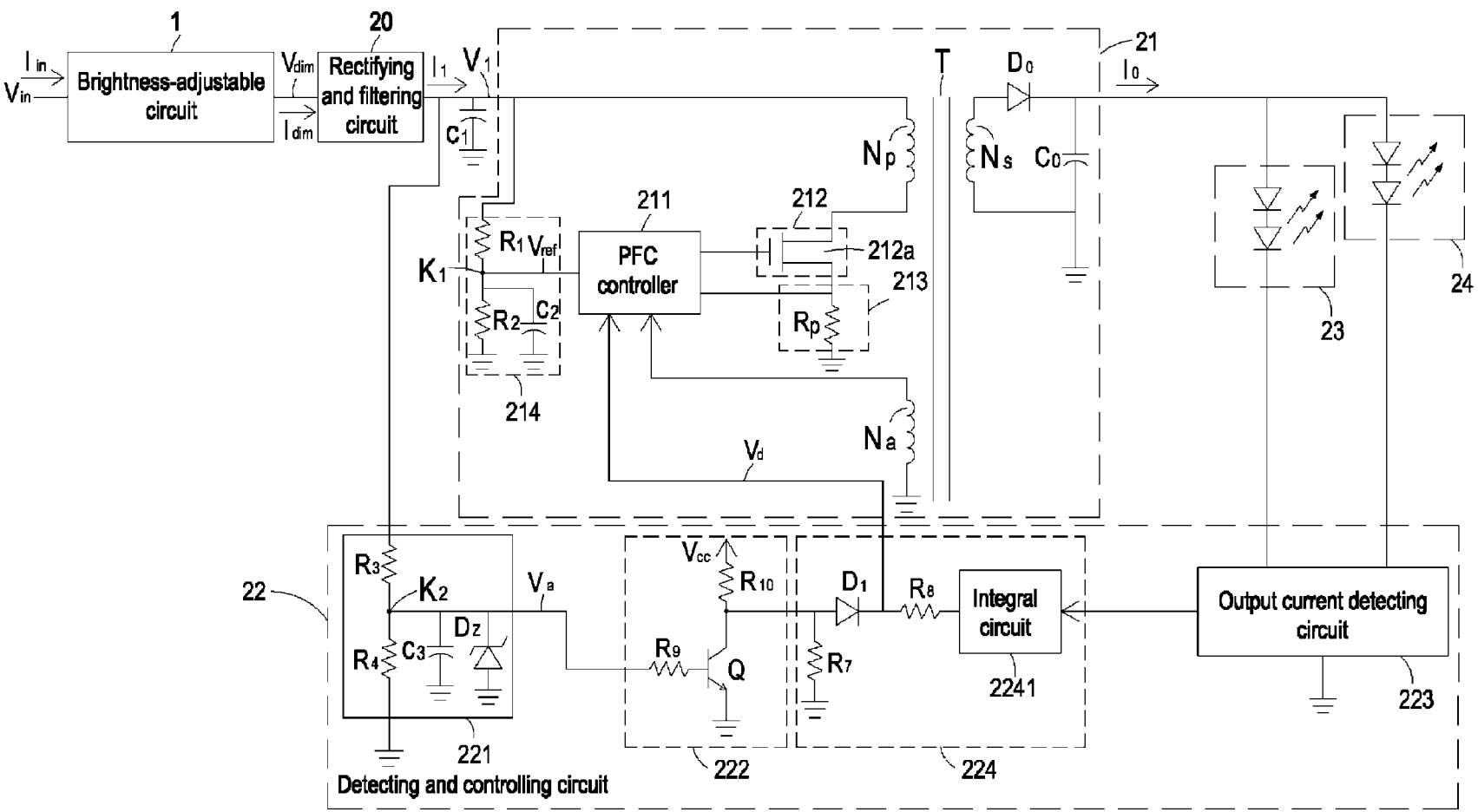
FIG. 6 is another schematic detailed circuit diagram of the brightness-adjustable LED driving circuit of FIG. 2.

Please refer to FIGS. 2, 5 and 6. FIG. 6 is another schematic detailed circuit diagram of the brightness-adjustable LED driving circuit of FIG. 2. In comparison with the brightness-adjustable LED driving circuit of FIG. 3, an output diode $D_o$ and an output capacitor $C_o$ are included in the output side of the PFC power conversion circuit 21 and the phase processing circuit 222 is distinguished. The output diode $D_o$ is connected to the output loop of the PFC power conversion circuit 21 in series for rectification. The output capacitor $C_o$ is connected to the LED strings and the command terminal for filtering or stabilizing the output voltage of the PFC power conversion circuit 21. In addition, the phase processing circuit 222 comprises a ninth resistor $R_9$, a tenth resistor $R_{10}$ and a transistor Q. Both ends of the ninth resistor $R_9$ are connected to the output terminal of the power detecting circuit 221 and the base of the transistor Q. The tenth resistor $R_{10}$ has an end connected to the DC source voltage $V_{cc}$ and the other end connected to the collector of the transistor Q and the feedback circuit 224. By cooperation of the ninth resistor $R_9$, the tenth resistor $R_{10}$ and the transistor Q, the phase signal is transmitted to the feedback circuit 224 according to the phase data of the brightness adjusting voltage $V_{dim}$.

Figure 7:
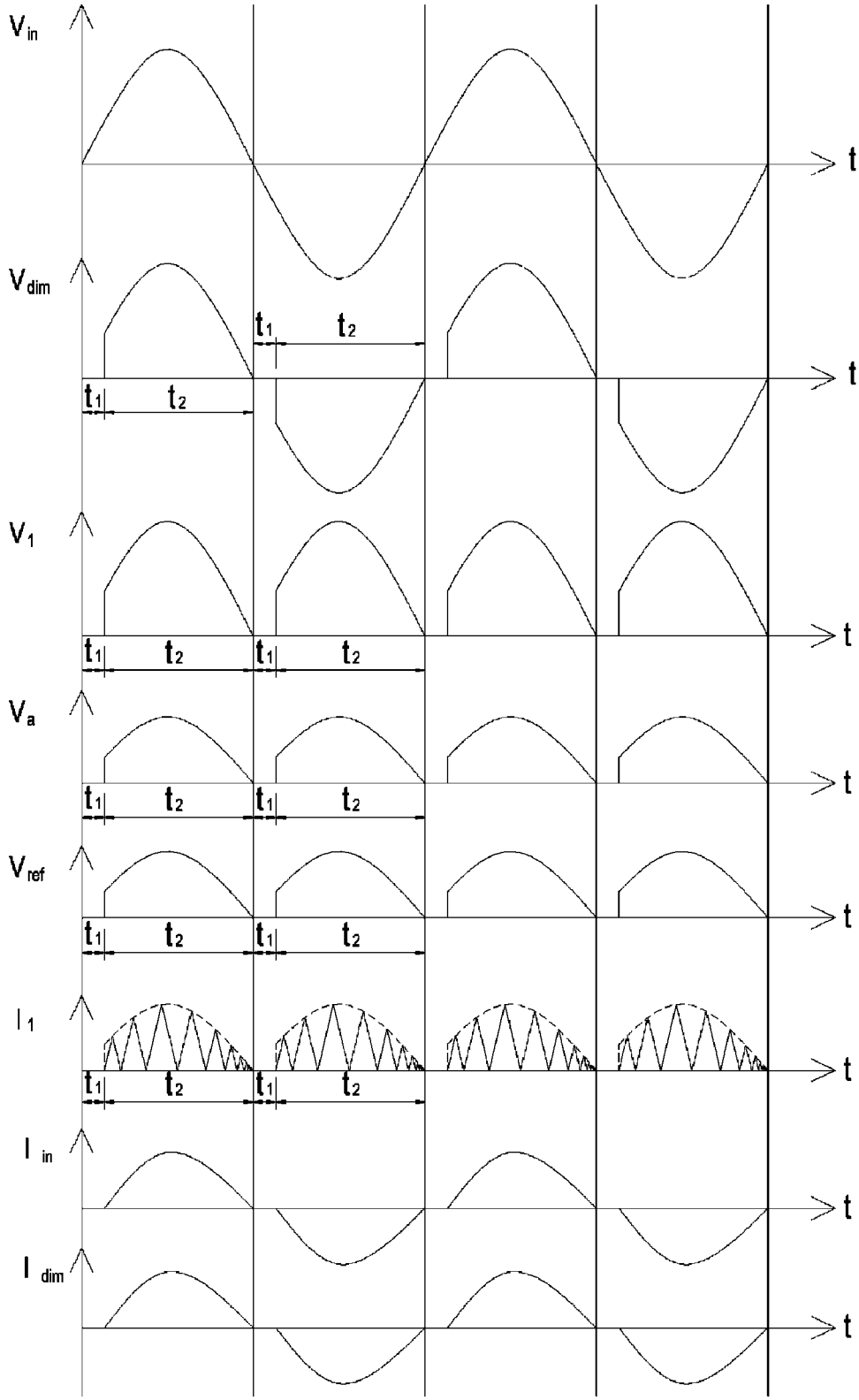
FIG. 7 is a timing waveform diagram illustrating related voltage signals and current signals described in the brightness-adjustable LED driving circuit of FIG. 2.

Please refer to FIGS. 2, 3, 4, 5, 6 and 7. FIG. 7 is a timing waveform diagram illustrating related voltage signals and current signals described in the brightness-adjustable LED driving circuit of FIG. 2. The input voltage $V_{in}$ is an AC voltage. By the brightness-adjustable circuit 1, the on phase or on duration of the input voltage $V_{in}$ is adjusted to generate the brightness adjusting voltage $V_{dim}$. During operation of the brightness-adjustable circuit 1, the off duration $t_1$ and the on duration $t_2$ of the brightness adjusting voltage $V_{dim}$, are changeable. By the rectifying and filtering circuit 20, the brightness adjusting voltage $V_{dim}$, is rectified into the first DC voltage $V_1$. According to the on phase or on duration of the brightness adjusting voltage $V_{dim}$, and the output current $I_o$ of the PFC power conversion circuit 21, a control signal $V_d$ is transmitted to the PFC controller 211 of the PFC power conversion circuit 21. As a consequence, the output current $I_o$ of the PFC power conversion circuit 21 is changed according to the phase data (e.g. the on phase or on duration) of the brightness adjusting voltage $V_{dim}$. By detecting the first DC voltage $V_1$, the power detecting circuit 221 of the detecting and controlling circuit 22 generates the a power detecting signal $V_a$. The power detecting signal $V_a$ is received and processed by the phase processing circuit 222, thereby acquiring the phase data of the brightness adjusting voltage $V_{dim}$. According to the phase data of the brightness adjusting voltage $V_{dim}$, a phase signal is transmitted to the feedback circuit 224. According to the phase signal issued by the phase processing circuit 222 and the current detecting signal issued by the output current detecting circuit 223, the feedback circuit 224 issues a corresponding control signal $V_d$ to the PFC controller 211 of the PFC power conversion circuit 21. As a consequence, the output current $I_o$ of the PFC power conversion circuit 21 is changed according to the phase data of the brightness adjusting voltage $V_{dim}$. In particular, the control signal $V_d$ generated by the feedback circuit 224 is adjusted according to the phase data of the brightness adjusting voltage $V_{dim}$ and the output current $I_o$ of the PFC power conversion circuit 21. In other words, according to the control signal $V_d$, the detecting and controlling circuit 22 will control the output current $I_o$ of the PFC power conversion circuit 21 to be changed according to the phase data of the brightness adjusting voltage $V_{dim}$.

For obtaining the accurate waveform of the brightness adjusting voltage $V_{dim}$, the switch element (not shown) of the brightness-adjustable circuit 1 is preferably operated at the minimum on current value (e.g. 50 mA). In other words, during the on period of the brightness adjusting voltage $V_{dim}$, the output current (i.e. a first current $I_1$) of the rectifying and filtering circuit 20 is kept above the minimum on current value and uniformly distributed. During the on period of the brightness adjusting voltage $V_{dim}$, the switching circuit 212 is intermittently conducted or shut off under control of the PFC controller 211. As a consequence, the first current $I_1$ is intermittently increased or decreased and uniformly distributed. As shown in FIG. 7, the envelop curve of the first current $I_1$ (as is indicated as a dotted line) is similar to the waveform of the first DC voltage $V_1$. During the on period of the brightness adjusting voltage $V_{dim}$, the first current $I_1$ is continuously maintained above the minimum on current value. In addition, since the brightness adjusting current $I_{dim}$ and the input current $I_{in}$, are uniformly distributed and have similar waveforms, the brightness-adjustable circuit 1 can be stably operated. Since the primary winding assembly $N_p$ of the transformer T of the PFC power conversion circuit 21 is able to filter off the high-frequency current component, the brightness adjusting current $I_{dim}$ and the input current $I_{in}$, are uniformly distributed and have smooth waveforms similar to the brightness adjusting voltage $V_{dim}$. As a consequence, the brightness-adjustable LED driving circuit 2 of the present invention has enhanced power factor and reduced electromagnetic interference (EMI).

In the above embodiments, the PFC controller 211 is controlled in response to the control signal $V_d$ issued by the detecting and controlling circuit 22. For accurately controlling the on duration and the off duration of the switching circuit 212 during the on period of the brightness adjusting voltage $V_{dim}$ in order to achieve uniformly distributed first current $I_1$ and an envelop curve similar to the waveform of the first DC voltage $V_1$, the waveform of the first DC voltage $V_1$ and the voltage and current waveforms of the primary winding assembly $N_p$ are critical for the PFC controller 211. In addition, since the first DC voltage $V_1$ is subject to voltage division to generate the reference voltage $V_{ref}$, the waveform of the reference voltage $V_{ref}$ is identical to that of the first DC voltage $V_1$. In addition, the auxiliary winding assembly $N_a$ can sense the same waveform as the voltage across the primary winding assembly $N_p$ and the current detecting circuit 213 can sense the current generated by the primary winding assembly $N_p$. According to the reference voltage $V_{ref}$ and the voltage and the current of the primary winding assembly $N_p$, the PFC controller 211 may control on or off statuses of the switching circuit 212. As a consequence, a current is generated by the primary winding assembly $N_p$, the electrical energy is stored in or transmitted to the secondary winding assembly $N_s$, the first current $I_1$ is uniformly distributed, and the envelop curve of the first current $I_1$ is similar to the waveform of the first DC voltage $V_1$. Moreover, the brightness adjusting current $I_{dim}$ and the input current $I_{in}$, are uniformly distributed and have smooth waveforms similar to the brightness adjusting voltage $V_{dim}$.

In the above embodiments, the power detecting signal $V_a$ is generated when the first DC voltage $V_1$ is subject to voltage division. As a consequence, the off duration $t_1$ and the on duration $t_2$ of the power detecting signal $V_a$ are substantially identical to those of the brightness adjusting voltage $V_{dim}$. According to the power detecting signal $V_a$, the processing phase circuit 222 detects the off duration $t_1$ and the on duration $t_2$ of the power detecting signal $V_a$. After computation by the processing phase circuit 222, corresponding off phase $\theta_1$ and on phase $\theta_2$ are obtained. According to the magnitudes of the off phase $\theta_1$ and on phase $\theta_2$, the processing phase circuit 222 generates a corresponding phase signal. According to the phase signal, the feedback circuit 224 issues a control signal $V_d$ to the PFC controller 211 of the PFC power conversion circuit 21. As a consequence, the output current $I_o$ of the PFC power conversion circuit 21 is in direct proportion to the on phase $\theta_2$ or the on duration $t_2$ of the brightness adjusting voltage $V_{dim}$.

In the above embodiments, the output terminal of the brightness-adjustable LED driving circuit 2 is electrically connected to the first LED string 23 and the second LED string 24. Consequently, the brightness-adjustable LED driving circuit 2 provides electricity required for powering the first LED string 23 and the second LED string 24. According to the on phase or on duration of the brightness adjusting voltage $V_{dim}$, the output current $I_o$ of the brightness-adjustable LED driving circuit 2 is varied. Therefore, the brightness of the light emitted by the first LED string 23 and the second LED string 24 will be changed according to the on phase or on duration of the brightness adjusting voltage $V_{dim}$.

From the above description, the brightness-adjustable LED driving circuit of the present invention can cooperate with a brightness-adjustable circuit to adjust brightness of one or more LED strings while avoiding the problem of burning out the LED driving circuit or the brightness-adjustable circuit or flashing the LED. By the brightness-adjustable LED driving circuit of the present invention, the brightness adjusting current $I_{dim}$ and the input current $I_{in}$ are uniformly distributed and have smooth waveforms similar to the brightness adjusting voltage $V_{dim}$. Since there is nearly no phase difference between the brightness adjusting current $I_{dim}$ and the brightness adjusting voltage $V_{dim}$, the brightness-adjustable LED driving circuit is nearly operated according to the pure resistive property of the incandescent lamp. As a consequence, the brightness-adjustable LED driving circuit has enhanced power factor and reduced electromagnetic interference (EMI).

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A brightness-adjustable LED driving circuit for driving at least one LED string and adjusting brightness of said at least one LED string, said brightness-adjustable LED driving circuit comprising:

a brightness-adjustable circuit for receiving an input AC voltage and adjusting the phase of said input AC voltage, thereby generating a brightness adjusting voltage;

a rectifying and filtering circuit electrically connected to an output terminal of said brightness-adjustable circuit for filtering and rectifying said brightness adjusting voltage into a first DC voltage;

a power factor correction power conversion circuit electrically connected to said rectifying and filtering circuit and said at least one LED string for generating an output current required for powering said at least one LED string, wherein said power factor correction power conversion circuit comprises a power factor correction controller; and a detecting and controlling circuit connected to said rectifying and filtering circuit and said power factor correction controller of said power factor correction power conversion circuit for detecting phase data of said brightness adjusting voltage and said output current generated by said power factor correction power conversion circuit, and generating a control signal to said power factor correction controller according to said phase data of said brightness adjusting voltage, so that the magnitude of said output current is changed according to said phase data of said brightness adjusting voltage;

wherein an input current of said brightness-adjustable LED driving circuit is controlled to have a waveform similar to said brightness adjusting voltage under control of said power factor correction controller of said power factor correction power conversion circuit.

2. The brightness-adjustable LED driving circuit according to claim 1 further comprising a first capacitor, which is electrically connected to said rectifying and filtering circuit, said power factor correction power conversion circuit and said detecting and controlling circuit.

3. The brightness-adjustable LED driving circuit according to claim 1 wherein said power factor correction power conversion circuit comprises:

a transformer comprising a primary winding assembly and a secondary winding assembly, wherein said primary winding assembly is connected to said rectifying and filtering circuit, and said secondary winding assembly is connected to said detecting and controlling circuit and said at least one LED string; and a switching circuit electrically connected to said primary winding assembly of said transformer and said power factor correction controller, wherein said switching circuit is intermittently conducted or shut off under control of said power factor correction controller such that a current is generated by said primary winding assembly and an electrical energy is stored in or transmitted to said secondary winding assembly.

4. The brightness-adjustable LED driving circuit according to claim 3 wherein said switching circuit is intermittently conducted or shut off under control of said power factor correction controller such that an envelop curve of a current outputted by said rectifying and filtering circuit is similar to the waveform of said first DC voltage.

5. The brightness-adjustable LED driving circuit according to claim 4 wherein said switching circuit includes a metal oxide semiconductor field effect transistor (MOSFET).

6. The brightness-adjustable LED driving circuit according to claim 4 wherein said power factor correction power conversion circuit further comprises a current detecting circuit, which is electrically connected to said switching circuit and issues a current detecting signal according to said current generated by said primary winding assembly.

7. The brightness-adjustable LED driving circuit according to claim 4 wherein said power factor correction power conversion circuit further comprises a voltage detecting circuit, which is electrically connected to said primary winding assembly and said rectifying and filtering circuit and issues a reference voltage to said power factor correction controller according to said first DC voltage.

8. The brightness-adjustable LED driving circuit according to claim 7 wherein said voltage detecting circuit comprises a first resistor and a second resistor, which are connected in series to a first node, and said first DC voltage is subject to voltage division to generate said reference voltage.

9. The brightness-adjustable LED driving circuit according to claim 8 wherein said voltage detecting circuit further comprises a second capacitor, which is connected to said second resistor in parallel.

10. The brightness-adjustable LED driving circuit according to claim 3 wherein said transformer further comprises an auxiliary winding assembly, which is electrically connected to said power factor correction controller, for sensing a voltage of said primary winding assembly to allow said power factor correction controller to discriminate whether said primary winding assembly is in a zero-current state, and providing operation power of said power factor correction controller.

11. The brightness-adjustable LED driving circuit according to claim 1 wherein said detecting and controlling circuit further comprises:

a power detecting circuit electrically connected to said rectifying and filtering circuit for generating a power detecting signal according to said brightness adjusting voltage;

a phase processing circuit electrically connected to said power detecting circuit for receiving and processing said power detecting signal to acquire said phase data of said brightness adjusting voltage, and generating a phase signal according to said phase data of said brightness adjusting voltage;

an output current detecting circuit electrically connected to an output loop of said power factor correction power conversion circuit for detecting said output current of said power factor correction power conversion circuit and generating an output current detecting signal; and a feedback circuit electrically connected to said phase processing circuit, said power factor correction controller and said output current detecting circuit, and issuing said control signal to said power factor correction controller according to said phase signal and said output current detecting signal such that said output current of said power factor correction power conversion circuit is changed according to said phase data of said brightness adjusting voltage.

12. The brightness-adjustable LED driving circuit according to claim 11 wherein said power detecting circuit comprises a third resistor and a fourth resistor, which are connected in series to a second node, and said first DC voltage is subject to voltage division to generate said power detecting signal.

13. The brightness-adjustable LED driving circuit according to claim 12 wherein said power detecting circuit comprises a third capacitor and a Zener diode, which are connected to said second node.

14. The brightness-adjustable LED driving circuit according to claim 11 wherein said phase processing circuit comprises:

a processor;

a fifth resistor connected to said processor for limiting current; and a sixth resistor connected to said fifth resistor and a DC source voltage for pulling up voltage.

15. The brightness-adjustable LED driving circuit according to claim 11 wherein said feedback circuit comprises:

a first diode having an anode connected to an output terminal of said phase processing circuit;

an integral circuit connected to an output terminal of said output current detecting circuit; and a seven resistor having an end connected to a common terminal and the other end connected to said output terminal of said phase processing circuit and said anode; and an eight resistor having an end connected to said power factor correction controller and a cathode of said first diode and the other end connected to an output terminal of said integral circuit.

16. The brightness-adjustable LED driving circuit according to claim 11 wherein said phase processing circuit comprises:

a ninth resistor having an end connected to an output terminal of said power detecting circuit and the base of said transistor; and a tenth resistor having an end connected to said DC source voltage and the other end connected to the collector of said transistor and said feedback circuit.

17. The brightness-adjustable LED driving circuit according to claim 11 wherein said power factor correction power conversion circuit further comprises:

an output diode connected to output loop of said power factor correction power conversion circuit for rectification; and an output capacitor connected to said at least one LED string for filtering or stabilizing the output voltage of said power factor correction power conversion circuit.

18. The brightness-adjustable LED driving circuit according to claim 1 wherein said power factor correction power conversion circuit is a single-stage power conversion circuit, and said at least one LED string comprises a plurality of LED strings.

19. A brightness-adjustable LED driving circuit for driving at least one LED string and adjusting brightness of said at least one LED string, said brightness-adjustable LED driving circuit comprising:

a rectifying and filtering circuit for filtering and rectifying a brightness adjusting voltage into a first DC voltage;

a power factor correction power conversion circuit electrically connected to said rectifying and filtering circuit and said at least one LED string for generating an output current required for powering said at least one LED string, wherein said power factor correction power conversion circuit comprises a power factor correction controller; and a detecting and controlling circuit connected to said rectifying and filtering circuit and said power factor correction controller of said power factor correction power conversion circuit for detecting phase data of said brightness adjusting voltage and said output current generated by said power factor correction power conversion circuit, and generating a control signal to said power factor correction controller according to said phase data of said brightness adjusting voltage, so that the magnitude of said output current is changed according to said phase data of said brightness adjusting voltage;

wherein an input current of said brightness-adjustable LED driving circuit is controlled to have a waveform similar to said brightness adjusting voltage under control of said power factor correction controller of said power factor correction power conversion circuit.

* * * * *